United States Patent [19]

Lundqvist

[11] 3,981,526

[45] Sept. 21, 1976

[54] SPIKE TOOL

[76] Inventor: Karl Gustav Emanuel Lundqvist, Molinsgatan 4, S-411 33 Goteborg, Sweden

[22] Filed: Dec. 24, 1974

[21] Appl. No.: 536,096

[30] Foreign Application Priority Data

Dec. 28, 1973 Sweden ..... 7317511
Oct. 30, 1974 Sweden ..... 7413643

[52] U.S. Cl. ..... 294/25; 30/298
[51] Int. Cl.[2] ..... B26B 27/00; B65G 7/12
[58] Field of Search ..... 294/1 R, 25, 26, 61, 294/131; 2/16, 20, 158–160, 161 R, 161 A; 9/14; 30/232, 298, 291; 130/4, 31 A

[56] References Cited

UNITED STATES PATENTS

| | | | |
|---|---|---|---|
| 816,681 | 4/1906 | Piller | 9/14 |
| 1,192,160 | 7/1916 | Boice | 130/4 |
| 1,217,905 | 3/1917 | Boice | 294/25 X |
| 1,346,894 | 7/1920 | Jacobs | 294/25 |
| 2,192,203 | 3/1940 | Purdy | 9/14 |
| 2,805,883 | 9/1957 | Sauvago | 294/26 |

*Primary Examiner*—Johnny D. Cherry
*Attorney, Agent, or Firm*—Plumley and Tyner

[57] ABSTRACT

A spike tool supported on a holder with means whereby the tool may be attached to a hand. The tool is particularly intended for lifesaving purposes, allowing the wearer to obtain a firm hold on slippery surfaces, such as ice. The tool may include means holding a throwing bag and a rescue rope (lifeline).

3 Claims, 11 Drawing Figures

SPIKE TOOL

BACKGROUND OF THE INVENTION

The present invention concerns an improved spike tool particularly intended to dig into slippery surfaces, such as ice and the like and comprising a spike holder connected with means whereby the tool may be attached to a hand. The resulting tool is of a kind that may always be at hand and is readily available, should immediate life saving operations be necessary to rescue persons involved in various activities on unsafe ice or slippery beach rocks, such as during sports fishing and other outdoor activities.

Various embodiments of tools of this kind are already known, all of them suffering, however, from such structural deficiencies that they are not strong enough to take the considerable forces needed in life saving operations, in addition to which the tool working position is such as to prevent efficient utilization.

SUMMARY OF THE INVENTION

The tool in accordance with the invention is constructed so as to eliminate the above-mentioned drawbacks. It is characteristic of the invention that the spike holder consists of a spike handle intended to rest in the hand, and of a support rail extending essentially at right angles from the spike handle along the side of the hand opposite the thumb in a direction towards the wrist, and that the spike proper is rigidly secured to the associated spike holder and extends in the plane of the hand transversely from the support rail.

BRIEF DESCRIPTION OF THE DRAWINGS

The advantages and further characteristics of the present invention will become apparent upon reading of the following detailed description with reference to the accompanying drawings, wherein.

DETAILED DESCRIPTION OF A PREFERRED EMBODIMENT

Figure 1:
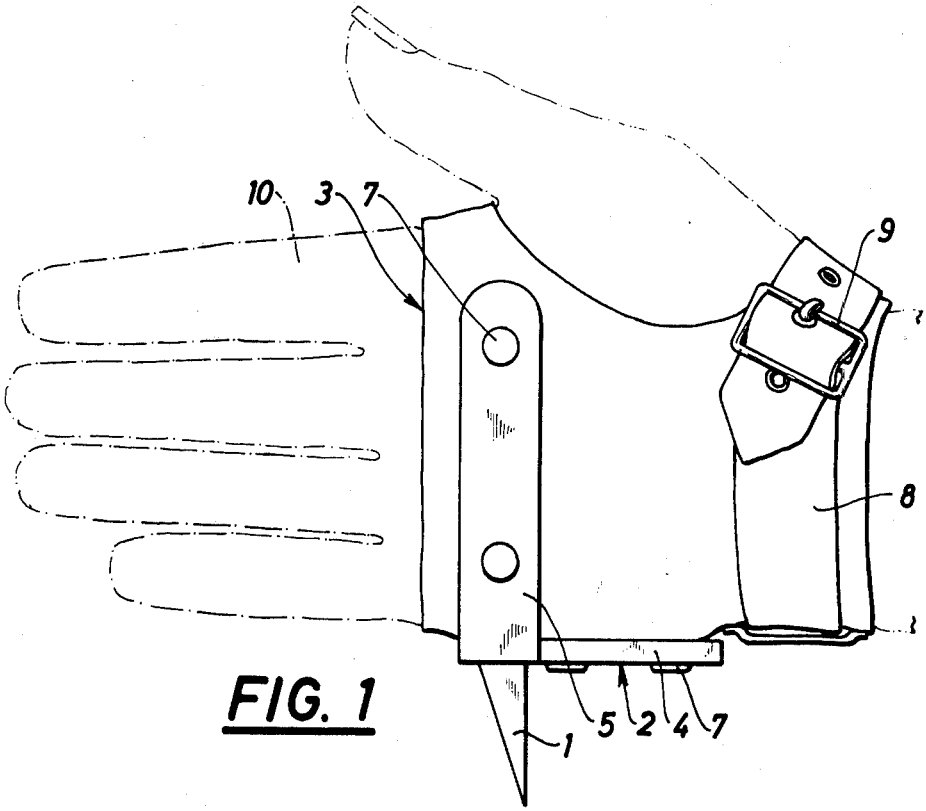
FIG. 1 is a view of the spike tool in accordance with the invention as intended for right-hand use, as seen from the palm side of the hand.
Figure 2:
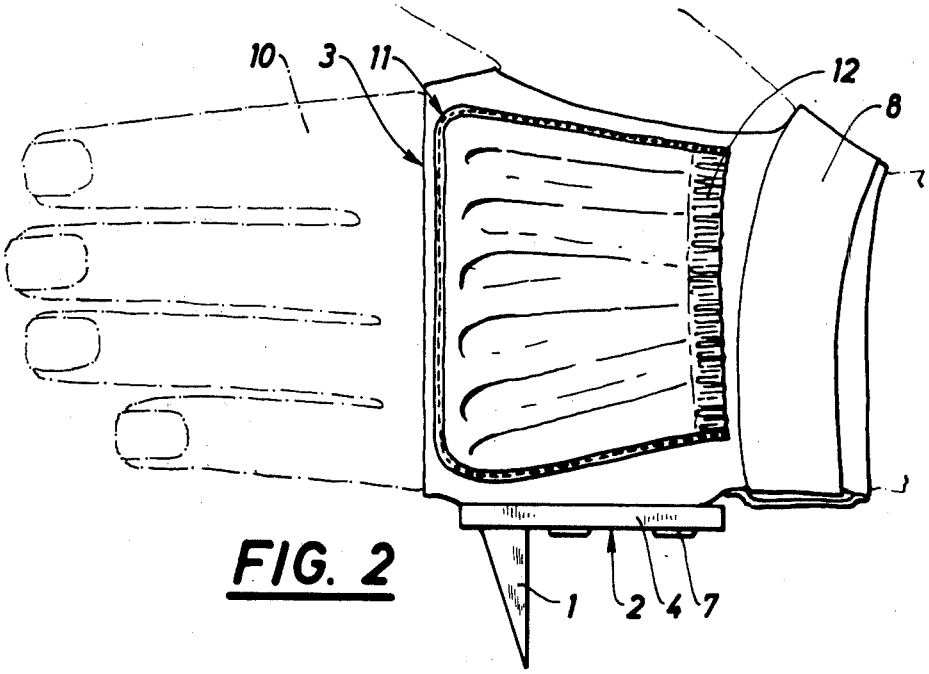
FIG. 2 is a view of the tool in accordance with the invention as intended for left-hand use, as seen from the outside of the hand.
Figure 3:
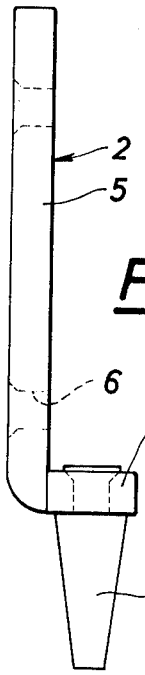
FIGS. 3, 4, and 5 are three various views of the spike itself with its associated spike holder.
Figure 4:
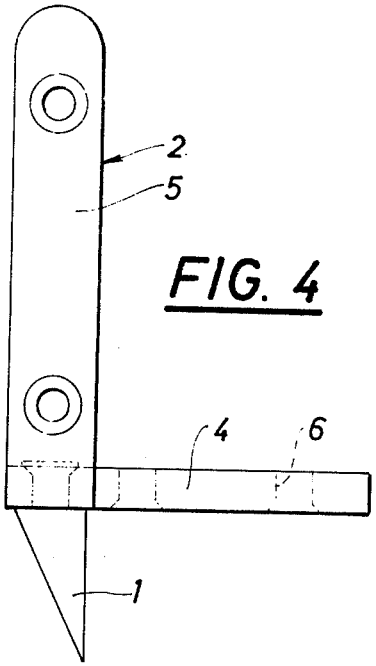
Figure 5:
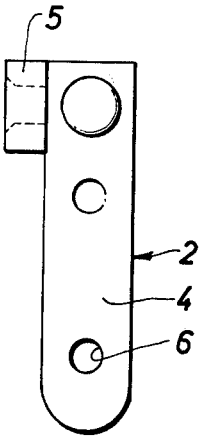

In accordance with the embodiment illustrated in FIGS. 1 and 2, the spike tool in accordance with the invention comprises a spike 1, a spike holder 2 to which the spike is rigidly secured, and a glove part 3 attached to the spike holder. The spike holder 2 consists of a support rail 4 (see also FIGS. 3, 4, and 5), at the outer face of which the spike is secured, such as by riveting or welding, and a spike handle 5 extending at right angles to the rail and rigidly connected to the spike adjacent the rail. The support rail 4 and the spike handle 5 are provided with bores 6 to receive rivets 7 by means of which the spike holder 2 is secured to the glove part 3.

With the spike tool described above it is possible to dig into the surface, e.g. ice, and obtain strong engagement therewith without causing damage to the hand. This is possible in that the spike handle 5 rests in the palm of the hand, whereby the hand and fingers may be closed about the spike handle so as to have a very firm grip thereon while at the same time the support rail 4 provides good stability and distributes the load exerted on the hand during use of the tool.

As appears from FIGS. 1 and 2, the glove part 3 lacks finger portions and preferably is made from some strong, yet pliable material such as leather, canvas or the like. In addition, the glove part is provided with a strap 8 with a buckle 9 which extends around the wrist and may be tightened so as to secure the glove part firmly on the hand 10. At the upper surface of the left hand, the glove part is provided with a bag-like pocket 11 the edge of which tightly closes the pocket by means of an elastic band 12 or the like. The pocket 11 is intended to hold a rescue rope (lifeline) 13 having a length of 4 to 5 meters, and a throwing bag 14. One end of the rope is secured to the spike tool, preferably to the spike holder 2 thereof, whereas the opposite end is secured to the throwing bag.

Figure 6:
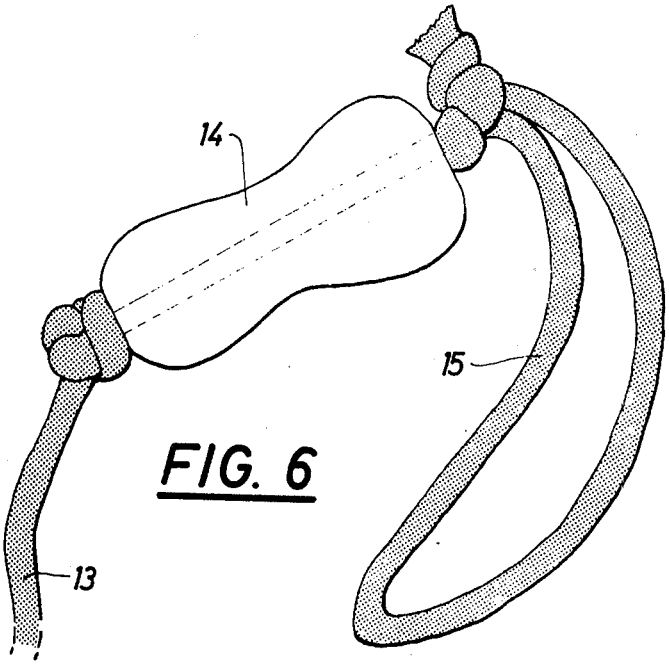
FIG. 6 illustrates a throwing bag associated with the tool and containing a rescue rope (lifeline)

In the embodiment illustrated in FIG. 6 the throwing bag 14 has a narrower portion or waist and preferably is made from leather, or some similar material and filled with sand, or possibly with some other material that will keep the throwing bag afloat on the water. At its outer end the throwing bag 14 is furthermore provided with a gripping loop 15 facilitating handling of the bag in cases of emergency.

The throwing bag 14 together with the rescue rope 13 are readily accessible in case of emergency in the pocket 11 or the upper surface of the left hand, whereby the bag may easily be thrown to the rescuer, or inversely, the rescuer, which in this case is assumed to be provided with the spike tool in accordance with the invention, may throw his bag 14 together with the rescue rope 13 to the person in distress.

Figure 7:
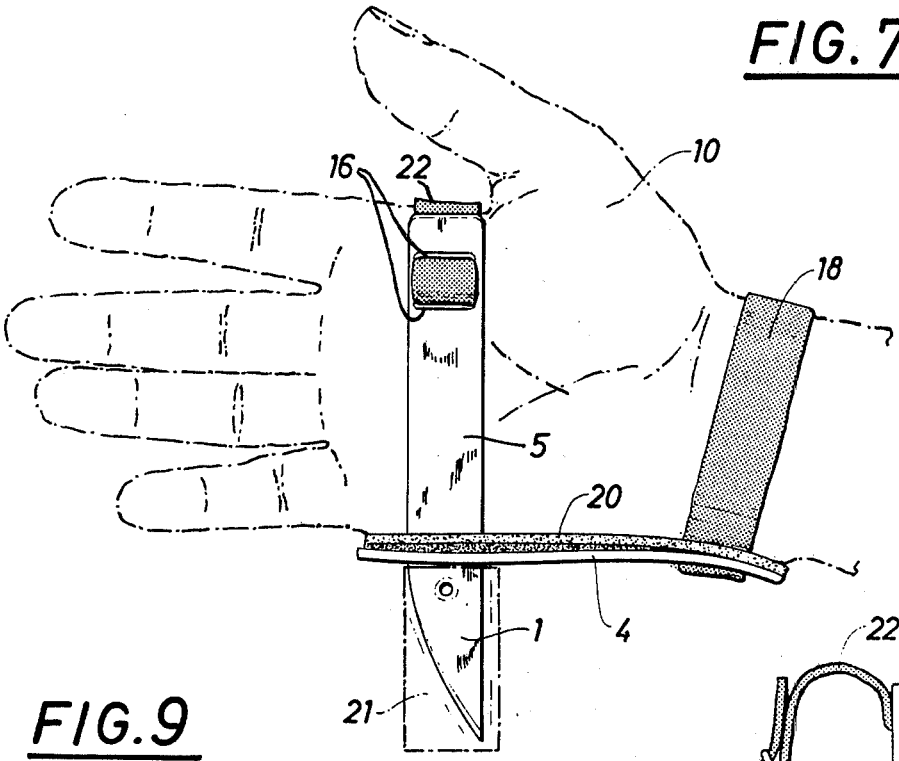
FIG. 7 illustrates in a side view the spike tool in accordance with a second embodiment, mounted on the hand of the wearer.
Figure 9:
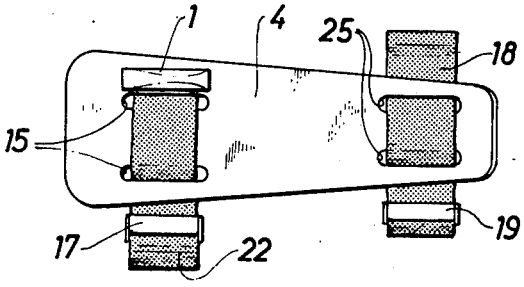
FIGS. 8 and 9 illustrate the spike tool in two additional views in accordance with this second embodiment.
Figure 8:
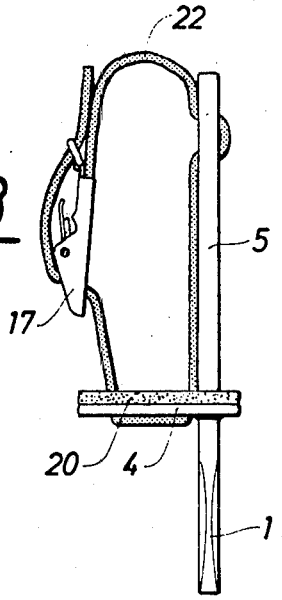

FIGS. 7 and 8 show another embodiment in accordance with which the spike 1 is provided on the extension of the spike handle 5 and preferably made integral with the handle. The support rail 4 is provided with two apertures 15 and the spike handle 5 wih two apertures 16 through which may pass a strap 22 carrying a buckle 17. As appears from FIG. 9, the support rail 4 is provided with two additional apertures 25 through which passes a second strap 18, likewise carrying a buckle 19. Furthermore, the support rail 4 is provided on the face thereof turned towards the hand with a layer 20 of some material which is kind to the hand, such as leather. In dash-and-dot lines is further suggested a protective cover or sleeve 21 enclosing the spike 1 and preferably made from a material through which the spike may penetrate, such as cardboard or plastics.

The spike tool in accordance with this embodiment is intended for attachment to one hand 10 of the wearer, one of the straps 22 being tightened around the metacarpus portion of the hand and the second strap 18 around the wrist. Through this arrangement the tool will be positioned, like in the first embodiment, with the support rail 4 extending in the longitudinal direction of the hand, over a portion thereof towards the wrist, and with the spike handle 5 in contact with the palm face of the hand transversely across the latter. When the need arises, the spike handle 5 is quickly grasped by the hand in a fist-like grip and when the spike 1 of the tool is stabbed into the ice the thrust is distributed over the entire portion of the hand abutting against the support rail 4. On account of the position of the spike 1 on the extension of the spike handle 5 no unnecessary torsional stress occurs when the wearer pulls himself towards the tool.

Figure 10:
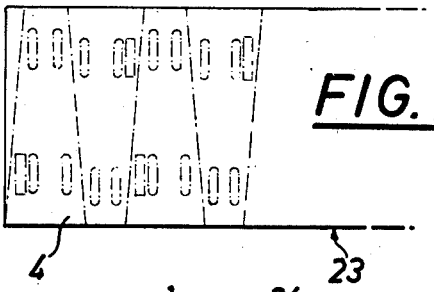
FIGS. 10 and 11 illustrate band blanks from which the support rail and the spike incorporated in the tool may be stamped.
Figure 11:
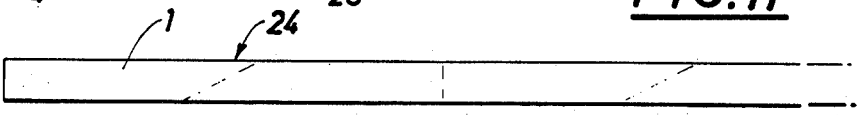

FIGS. 10 and 11 show how the starting material may be made use of without waste of material when the support rail 4 is stamped from a band blank 23 and the spike 1 from another band blank 24, the support rails 4 having the shape of an isosceles trapezoid which is alternatingly turned in opposite directions and the spikes 1 positioned in pairs with the spike tips facing one another.

What I claim is:

1. An improved spike tool, particularly intended to dig into slippery surfaces, such as ice and the like, comprising a spike holder means, a substantially straight spike mounted on said spike holder means, and means attaching said spike tool to a hand, said spike holder means comprising a spike handle adapted to rest in the palm of the hand for gripping engagement with said hand, and a support rail extending essentially at right angles from said spike handle along the side of the hand opposite the thumb in a direction towards the wrist, the spike proper rigidly secured to said spike holder so as to extend in the plane of the hand transversely from said support rail, a protective cover being arranged on said spike which is breakable by said spike.

2. An improved spike tool, particularly intended to dig into slippery surfaces, such as ice and the like, comprising a spike holder means, a substantially straignt spike mounted on said spike holder means, and means attaching said spike tool to a hand, said spike holder means comprising a spike handle adapted to rest in the palm of the hand for gripping engagement with said hand, and a support rail extending essentially at right angles from said spike handle along the side of the hand opposite the thumb in a direction towards the wrist, the spike proper rigidly secured to said spike holder so as to extend in the plane of the hand transversely from said support rail, a glove with no finger pieces thereon arranged to support said spike holder, a strap and a buckle arranged to be tightened around the wrist of said hand provided on said glove to secure said glove and said spike holder attached thereto to said hand and a pocket provided on said glove, a throwing bag and a rescue rope contained in said pocket, one end of said rope secured to said spike holder and the opposite end thereof secured to said throwing bag.

3. An improved spike tool, particularly intended to dig into slippery surfaces, such as ice and the like, comprising a spike holder means, a substantially straight spike mounted on said spike holder means, and means attaching said spike tool to a hand, said spike holder means comprising a spike handle adapted to rest in the palm of the hand for gripping engagement with said hand, and a support rail extending essentially at right angles from said spike handle along the side of the hand opposite the thumb in a direction towards the wrist, the spike proper rigidly secured to said spike holder so as to extend in the plane of the hand transversely from said support rail, two straps operatively connected with said support rail, the first one of said straps arranged to be tightened around said hand and the second one of said straps arranged to be tightened about the wrist of said hand to attach said spike tool to said hand, a first set of apertures formed in said support rail, and a second set of apertures formed in said spike handle at the end thereof opposite said support rail, the first one of said straps passing through said first and said second sets of apertures.

* * * * *